US010400605B2

(12) United States Patent
Nakashima et al.

(10) Patent No.: US 10,400,605 B2
(45) Date of Patent: Sep. 3, 2019

(54) TURBOFAN AND INDOOR UNIT FOR AIR CONDITIONING APPARATUS

(71) Applicant: Mitsubishi Electric Corporation, Tokyo (JP)

(72) Inventors: Seiji Nakashima, Tokyo (JP); Yoshiki Sato, Tokyo (JP); Keisuke Oishi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 263 days.

(21) Appl. No.: 15/507,013

(22) PCT Filed: Oct. 30, 2014

(86) PCT No.: PCT/JP2014/078892

§ 371 (c)(1),
(2) Date: Feb. 27, 2017

(87) PCT Pub. No.: WO2016/067409

PCT Pub. Date: May 6, 2016

(65) Prior Publication Data

US 2017/0275997 A1 Sep. 28, 2017

(51) Int. Cl.
*F01D 5/14* (2006.01)
*F04D 29/30* (2006.01)
(Continued)

(52) U.S. Cl.
CPC ..... *F01D 5/145* (2013.01); *F01D 5/04* (2013.01); *F04D 29/281* (2013.01); *F04D 29/30* (2013.01);
(Continued)

(58) Field of Classification Search
CPC ..... F01D 5/00; F01D 5/04; F01D 5/14; F01D 5/145; F01D 5/22; F04D 29/28;
(Continued)

(56) References Cited

U.S. PATENT DOCUMENTS 8,732,948 B2 * 5/2014 Nishino ..... F04D 29/023 156/272.8
8,784,060 B2 * 7/2014 Iwata ..... F04D 29/282 416/185
(Continued)

FOREIGN PATENT DOCUMENTS

EP 2213882 A1 8/2010
JP 02-027198 A 1/1990
(Continued)

OTHER PUBLICATIONS

International Search Report of the International Searching Authority dated Jan. 27, 2015 for the corresponding International application No. PCT/JP2014/078892 (and English translation).
(Continued)

*Primary Examiner* — John Kwon
*Assistant Examiner* — Johnny H Hoang
(74) *Attorney, Agent, or Firm* — Posz Law Group, PLC

(57) ABSTRACT

A turbofan includes a boss rotatable about an axis, a main plate connected to the boss, a shroud having an intake hole, and a plurality of blades arranged between the main plate and the shroud. An undulating protrusion portion is arranged at a front edge portion of each blade. The undulating protrusion portion includes a plurality of protrusions. The pitches of the plurality of protrusions are formed so as to become smaller as approaching to the main plate side.

5 Claims, 5 Drawing Sheets

(51) Int. Cl.
*F04D 29/28* (2006.01)
*F01D 5/04* (2006.01)
*F04D 29/66* (2006.01)

(52) U.S. Cl.
CPC ..... *F04D 29/666* (2013.01); *F05D 2240/303* (2013.01); *F05D 2250/183* (2013.01)

(58) Field of Classification Search
CPC .. F04D 29/281; F04D 29/222; F04D 29/2255; F04D 29/30; F04D 29/66; F04D 29/666; F04D 29/68; F04D 29/681
See application file for complete search history.

(56) References Cited

U.S. PATENT DOCUMENTS 9,243,646 B2 * 1/2016 Boll ..... F04D 29/2222
9,267,510 B2 * 2/2016 Tadokoro ..... F04D 29/30
9,951,782 B2 * 4/2018 Kurihara ..... F04D 29/30
2002/0028138 A1 * 3/2002 Lee ..... F04D 29/023 415/206
2012/0328420 A1 * 12/2012 Ikeda ..... F04D 29/281 415/177
2014/0023501 A1 * 1/2014 Ikeda ..... F04D 29/281 416/95

FOREIGN PATENT DOCUMENTS

JP 03-018693 A 1/1991
JP 2003-028089 A 1/2003
JP 2003-232295 A 8/2003
JP 2003-336599 A 11/2003
JP 2005-155510 A 6/2005
JP 2005-307868 A 11/2005
JP 2005-351141 A 12/2005
WO 2012/140690 A1 10/2012
WO 2014/061094 A1 4/2014

OTHER PUBLICATIONS

Extended European Search Report dated May 15, 2018 issued in corresponding EP patent application No. 14905027.0.

* cited by examiner

TURBOFAN AND INDOOR UNIT FOR AIR CONDITIONING APPARATUS

CROSS REFERENCE TO RELATED APPLICATION

This application is a U.S. national stage application of PCT/JP2014/078892 filed on Oct. 30, 2014, the disclosure of which is incorporated herein by reference.

TECHNICAL FIELD

The present invention relates to a turbofan and an indoor unit for an air conditioning apparatus.

BACKGROUND ART

As a technology for achieving a turbofan with less noise, for example, there is a structure disclosed in Patent Literature 1. A centrifugal fan disclosed in Patent Literature 1 includes an impeller including a main plate, a shroud, and a plurality of fan blades, a casing accommodating the impeller, and a suction bellmouth mounted to the casing. At a front edge portion of the fan blade, there is integrally formed a flat plate having the same thickness as that of the fan blade and a triangular shape. One side of the flat plate is held in close contact with the shroud at the front edge portion of the fan blade. With such a configuration, a flow on downstream of the suction bellmouth flows into the fan blade promptly and smoothly, and turbulence of the flow flowing into the fan blade is suppressed, thereby reducing noise.

Further, for example, in a centrifugal fan disclosed in Patent Literature 2, at an end (front edge portion) on an R direction side of a blade formed of a three dimensional blade, there is formed a front edge corner portion protruding toward an inner peripheral side of an impeller in a stepwise manner. The front edge corner portion is provided for an intention to obtain an effect of preventing an airflow from separating from a suction surface of the blade when the airflow sucked into the impeller through an inlet and a bellmouth is blown out to an outer peripheral side by the blade, thereby reducing noise of the fan.

CITATION LIST

Patent Literature

[PTL 1] JP 2005-307868 A (Page 5 and FIG. 1).

[PTL 2] JP 2005-155510 A (Page 9, paragraph 38, page 18, and FIG. 5)

SUMMARY OF INVENTION

Technical Problem

In the above-mentioned technology disclosed in Patent Literature 1, the flow on the main plate side of the blade cannot be controlled. Thus, there is a problem in that a sufficient effect of reducing noise cannot be obtained. Further, in the above-mentioned technology disclosed in Patent Literature 2, the front edge corner portion protruding toward the inner peripheral side of the impeller has a discontinuous stepwise shape to cause turbulence of the flow. Thus, there is a problem in that a sufficient effect of reducing noise cannot be obtained.

The present invention has been made in view of the above-mentioned circumstances, and has an object to provide a turbofan with less noise.

Solution to Problem

In order to achieve the above-mentioned object, according to one embodiment of the present invention, there is provided a turbofan, including: a boss rotatable about an axis of the turbofan; a main plate connected to the boss; a shroud having an intake hole; and a plurality of blades arranged between the main plate and the shroud, each of the plurality of blades including, at a front edge portion thereof, an undulating protrusion portion including a plurality of protrusions, the plurality of protrusions being arranged at pitches that become smaller as approaching to the main plate side.

Further, in order to achieve the above-mentioned object, according to one embodiment of the present invention, there is provided an indoor unit for an air conditioning apparatus, including the above-mentioned turbofan of the present invention.

Advantageous Effects of Invention

According to the present invention, it is possible to provide a turbofan generating less noise.

DESCRIPTION OF EMBODIMENTS

Figure 1:
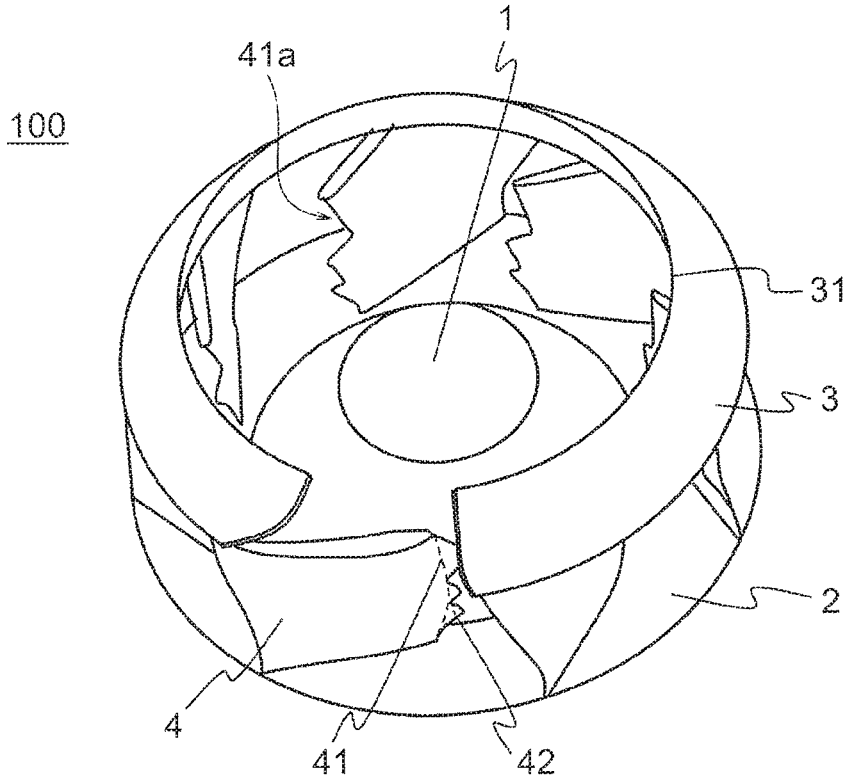
FIG. 1 is a perspective view of a turbofan according to a first embodiment of the present invention.

Now, with reference to the attached drawings, description is made of embodiments in which a turbofan (centrifugal fan) according to the present invention is carried out as a turbofan mounted to an indoor unit for an air conditioning apparatus. In the drawings, the same reference symbols represent the same or corresponding parts. Further, reference symbols relating to a plurality of blades are given only to a representative one of the plurality of blades. Further, in the drawings, a turbofan having seven blades is illustrated.

However, the turbofan thus illustrated is merely one example of the present invention. The effect of the present invention can be obtained through a turbofan with the number of blades other than seven.

First Embodiment

Figure 2:
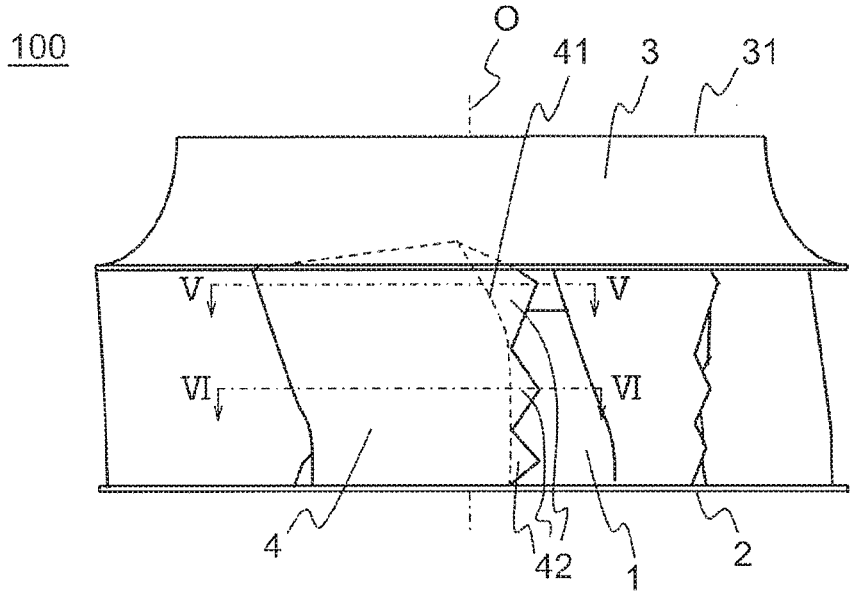
FIG. 2 is a side view of the turbofan according to the first embodiment of the present invention.
Figure 3:
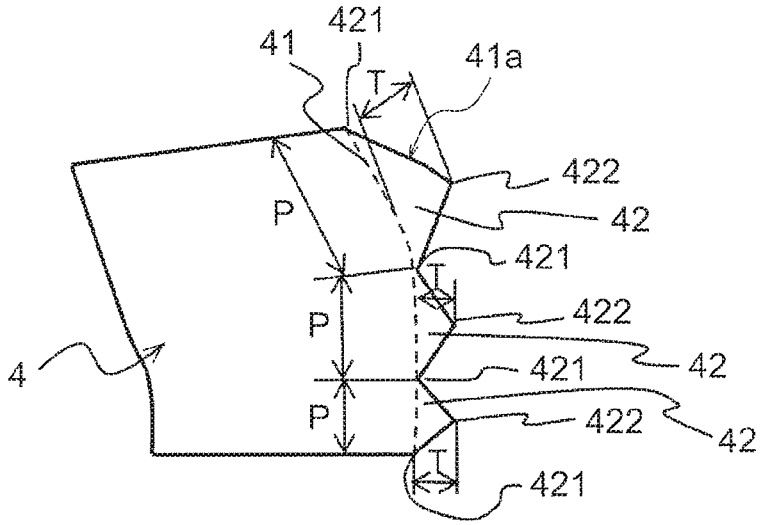
FIG. 3 is a view for illustrating a blade of the turbofan according to the first embodiment of the present invention.

FIG. 1 is a perspective view of a turbofan according to a first embodiment of the present invention. FIG. 2 is a side view of the turbofan according to the first embodiment of the present invention. FIG. 3 is a view for illustrating a blade of the turbofan according to the first embodiment of the present invention.

As illustrated in FIG. 1 to FIG. 3, a turbofan 100 according to the first embodiment includes a boss 1 rotatable about an axis O, a main plate 2 connected to the boss 1, a shroud 3 having an intake hole 31 configured to suck air, and a plurality of blades 4 arranged between the main plate 2 and the shroud 3.

An undulating protrusion portion 41*a* is formed at a front edge portion 41 of the blade 4. A plurality of protrusions 42 are ranged, to thereby form the undulating protrusion portion 41*a*.

A formation mode of the plurality of protrusions 42 is described with reference to pitches p. Each pitch P represents a distance in a direction along the front edge portion 41 of the blade 4, and a distance from a valley portion 421 of the protrusion 42 to an adjacent valley portion 421 of the protrusion 42. In other words, each pitch P represents the distance in the direction along the front edge portion 41 of the blade 4, and an interval between the valley portions 421 sandwiching a peak portion 422 of the protrusion 42 from both sides.

The pitches P of the protrusions 42 are set so as to become smaller as approaching to the main plate 2 side. That is, when the number of the protrusions 42 of the front edge portion 41 of the blade 4 is set to n, and the pitches P of the protrusions 42 are represented as a pitch P1, a pitch P2, . . . , and a pitch Pn, respectively, in the order from the shroud 3 side, a relationship of P1>P2> . . . >Pn is satisfied.

Figure 4:
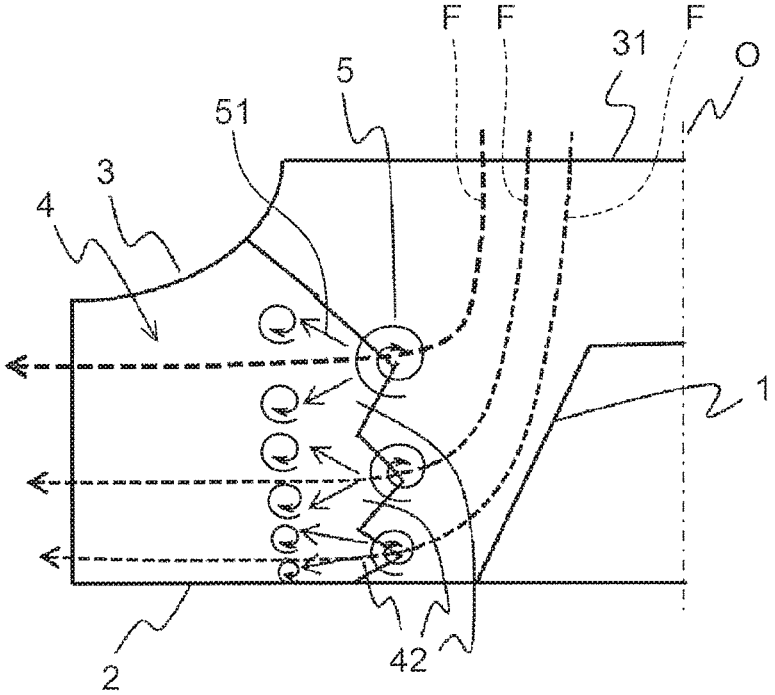
FIG. 4 is a schematic view of a flow inside the turbofan according to the first embodiment of the present invention.

With reference to FIG. 4, description is made of an effect obtained through the undulating protrusion portion 41*a*, which is configured as described above. FIG. 4 is a schematic view of a flow inside the turbofan according to the first embodiment of the present invention. As illustrated in FIG. 4, in a flow F inside the turbofan 100, an axial flow flowing through the intake hole 31 of the shroud 3 is bent in a radial direction before flowing into the blade 4. A bend from the axial flow to the radial flow causes unstability of the flow. Further, when an unstable flow flows into the blade 4, there may be a risk in causing a separation vortex 5. Further, an airflow is bent to a large extent on the shroud 3 side of the blade 4, and hence a size of the separation vortex 5 is larger. The airflow is bent to a small extent on the main plate 2 side, and hence the size of the separation vortex 5 is smaller.

In order to deal with the separation vortex 5 described above, in the first embodiment, there is provided the undulating protrusion portion 41*a* having the plurality of protrusions 42 ranged thereon, which are formed to have the pitches P that become smaller as approaching to the main plate 2 side. Thus, the pitches P of the protrusions 42 match with the size of the vortex. With this, the separation vertex 5 can effectively be divided 51, and fluctuation of the vortex being a noise source can be suppressed. Therefore, noise reduction and low power consumption can be achieved.

It is preferred that lengths T of the protrusions 42 of the front edge portion 41 of the blade 4 be within a range satisfying $0.2 \leq (T/P) \leq 0.8$. Here, the lengths T of the protrusions 42 of the front edge portion 41 of the blade 4 represent distances from the front edge portion 41 of the blade 4 to peak portions 422 of the protrusions 42 in a normal direction.

When a relationship of $0.2 > (T/P)$ is satisfied, the lengths T of the protrusions 42 are small. Thus, there may be a fear in that the separation vortex 5 cannot be divided sufficiently. When a relationship of $(T/P) > 0.8$ is satisfied, the lengths T of the protrusions 42 are large. Thus, there may be a fear in that protrusion surfaces may be abraded due to friction. As a countermeasure, the lengths T are set within a range satisfying $0.2 \leq (T/P) \leq 0.8$ to suppress increase in abrasion of the protrusion surfaces due to friction. With this, the separation vertex 5 can effectively be divided, and the fluctuation of the vortex being a noise source can be suppressed. Therefore, noise reduction and low power consumption can be achieved.

In the drawings, there is exemplified a case where the number of the protrusions 42 forming the undulating protrusion portion 41*a* of the front edge portion 41 of the blade 4 is three. However, the number of the protrusions 42 may be any arbitrary number more than or equal to two.

As described above, according to the first embodiment, the turbofan with less noise can be provided.

Second Embodiment

Figure 5:
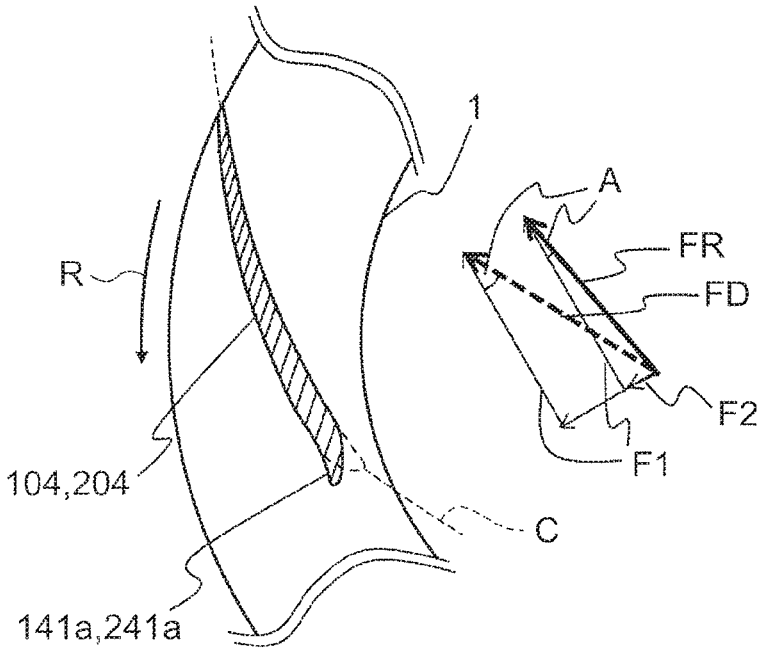
FIG. 5 is a partial sectional view of a turbofan, which is taken along the line V-V of FIG. 2, according to a second embodiment and a third embodiment of the present invention.

Next, with reference to FIG. 5, a second embodiment of the present invention is described. FIG. 5 is a partial sectional view of a turbofan, which is taken along the line V-V of FIG. 2, according to the second embodiment of the present invention. The second embodiment is the same as the above-mentioned first embodiment except for matters to be described below.

As illustrated in FIG. 5, in the turbofan according to the second embodiment, an undulating protrusion portion 141*a* of a front edge portion of a blade 104 is locally curved toward a radially outer side with respect to the axis O. In other words, the undulating protrusion portion 141*a* of the front edge portion of the blade 104 is locally curved toward a front side in a rotation direction R of the fan. Further, the undulating protrusion portion 141*a* is curved toward the radially outer side (toward the front side in the rotation direction R) so as to swerve from an extending direction of a blade thickness center line C of the blade 104, which is obtained by assuming that the undulating protrusion portion 41*a* is not curved. That is, the entire blade 104 does not extend toward the radially outer side as compared to a front portion of the blade, or does not extend toward the front side in the rotation direction R. As a whole, the blade 104 extends so that the front edge portion is positioned on a radially inner side on the main plate 2 as compared to a rear edge portion. In such blade 104, the undulating protrusion portion 141*a* is locally curved as described above.

As illustrated in FIG. 5, as for the flow inside the turbofan, the axial flow through the intake hole 31 is bent gradually in the radial direction inside the turbofan to become the radial flow. Thus, an inflow angle A of an actual incoming flow FR flowing into the blade 104 is smaller than an inflow angle A of an incoming flow FD in a two dimensional design in which only the radial flow is taken into account from the beginning. In FIG. 5, a reference symbol F1 represents a rotation flow component, and a reference symbol F2 represents a radial flow component (same in FIG. 6).

As a countermeasure for the above-mentioned problem, in the second embodiment, the undulating protrusion portion

141*a* of the front edge portion of the blade 104 is locally curved toward the front side in the rotation direction R of the fan. Thus, the inflow angle A flowing into the blade 104 matches with a curving angle of the undulating protrusion portion 141*a* of the front edge portion of the blade 104. Then, the flow flows into the blade 104 smoothly. With this, generation of the separation vortex 5 can be suppressed, and the fluctuation of the vortex being a noise source can be suppressed. Therefore, noise reduction and low power consumption can be achieved.

Third Embodiment

Figure 6:
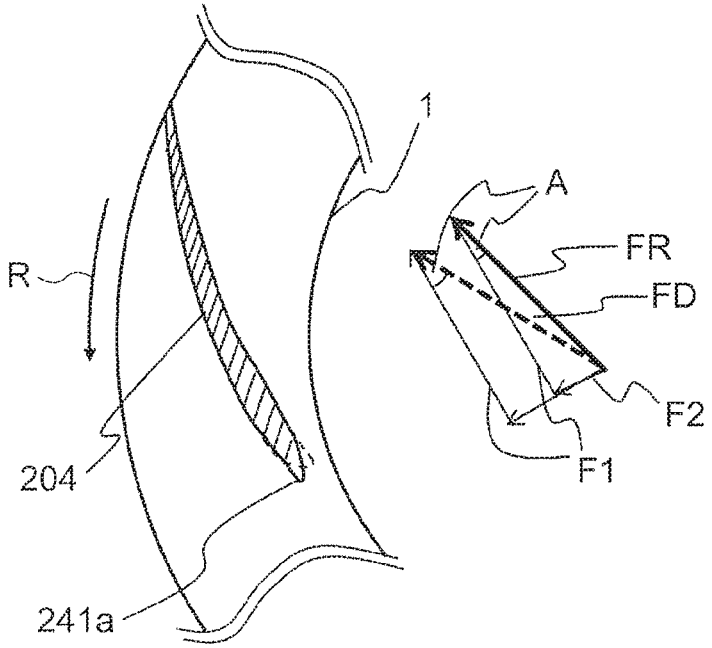
FIG. 6 is a partial sectional view of the turbofan, which is taken along the line VI-VI of FIG. 2, according to the third embodiment of the present invention.

Next, with reference to FIG. 5 and FIG. 6, a third embodiment of the present invention is described. FIG. 5 is a partial sectional view of a turbofan, which is taken along the line V-V of FIG. 2, according to the third embodiment of the present invention. Further, FIG. 6 is a partial sectional view of the turbofan, which is taken along the line VI-VI of FIG. 2, according to the third embodiment of the present invention. The third embodiment is the same as the above-mentioned first embodiment except for matters to be described below.

A cross section taken along the line VI-VI of FIG. 2, which is illustrated in FIG. 6, is a cross section of an undulating protrusion portion 241*a* of a front edge portion of a blade 204 more on the main plate 2 side as compared to a cross section taken along the line V-V of FIG. 2, which is illustrated in FIG. 5. An amount of the curve of the undulating protrusion portion 241*a* of the front edge portion of the blade 204 illustrated in FIG. 6, which is locally curved in the rotation direction of the fan, is smaller than an amount of the curve of the undulating protrusion portion 241*a* of the front edge portion of the blade 204 illustrated in FIG. 5, which is locally curved in the rotation direction of the fan. That is, in the turbofan according to the third embodiment, as illustrated in FIG. 5 and FIG. 6, the amount of the curve of the undulating protrusion portion 241*a* of the front edge portion of the blade 204, which is locally curved in the rotation direction of the turbofan is larger on the shroud 3 side.

With such a configuration, the following advantages can be obtained. As illustrated in FIG. 5 and FIG. 6, as for the flow inside the turbofan 100, the axial flow through the intake hole 31 is bent gradually in the radial direction inside the turbofan to become the radial flow. Thus, the inflow angle A of the actual incoming flow FR flowing into the blade 104 is smaller than the inflow angle A of the incoming flow FD in the two dimensional design in which only the radial flow is taken into account from the beginning. Meanwhile, a ratio of the axial flow to the radial flow is larger on the shroud side. Thus, the inflow angle A is smaller on the shroud side.

Therefore, as in the third embodiment, the amount of the curve of the undulating protrusion portion 241*a* of the front edge portion of the blade 204, which is locally curved in the rotation direction of the turbofan, is constructed to be larger on the shroud side. Thus, the inflow angle flowing into the blade 204 further matches with an angle of the undulating protrusion portion 241*a* of the front edge portion of the blade 204. Then, the flow flows into the blade 204 smoothly. With this, generation of the separation vortex 5 can be further reduced, and the fluctuation of the vortex being a noise source can be suppressed. Therefore, noise reduction and low power consumption can be achieved.

Fourth Embodiment

Figure 7:
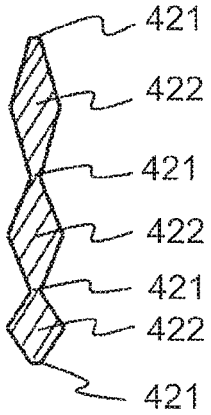
FIG. 7 is a view for illustrating a thickness distribution of an undulating protrusion of a front edge portion of a blade of a turbofan according to a fourth embodiment of the present invention.

Next, with reference to FIG. 7, a fourth embodiment of the present invention is described. The fourth embodiment is the same as the above-mentioned first to third embodiments except formatters to be described below.

FIG. 7 is a view for illustrating a thickness distribution of an undulating protrusion of a front edge portion of a blade of a turbofan according to the fourth embodiment of the present invention. To be more specific, FIG. 7 is a view for illustrating the thickness distribution in a cross section along the front edge portion of the blade. As illustrated in FIG. 7, a thickness of a valley portion 421 of each protrusion of an undulating protrusion portion of the blade of the turbofan according to the fourth embodiment is smaller than a thickness of a peak portion 422 of each protrusion of the undulating protrusion portion. That is, the thickness of the undulating protrusion portion (front edge portion) has a relative relation. The thickness is small at the valley portion 421 of each protrusion, and the thickness is large at the peak portion 422 of each protrusion.

With such a configuration, the following advantages can be obtained. As described with reference to FIG. 4, when the separation vortex 5 is divided by the undulating protrusion portion, vortexes divided from the peak portion 422 of each protrusion toward the volley portion 421 of each protrusion are generated. The thickness distribution is set so that the thickness is small at the valley portion 421 of each protrusion and that the thickness is large at the peak portion 422 of each protrusion. With this, an inclination from the peak portion 422 of each protrusion to the valley portion 421 of each protrusion is formed to promote division of the separation vortex 5. With this, the separation vortex 5 can further effectively be divided, and the fluctuation of the vortex being a noise source can be suppressed. Therefore, noise reduction and low power consumption can be achieved.

Fifth Embodiment

Figure 8:
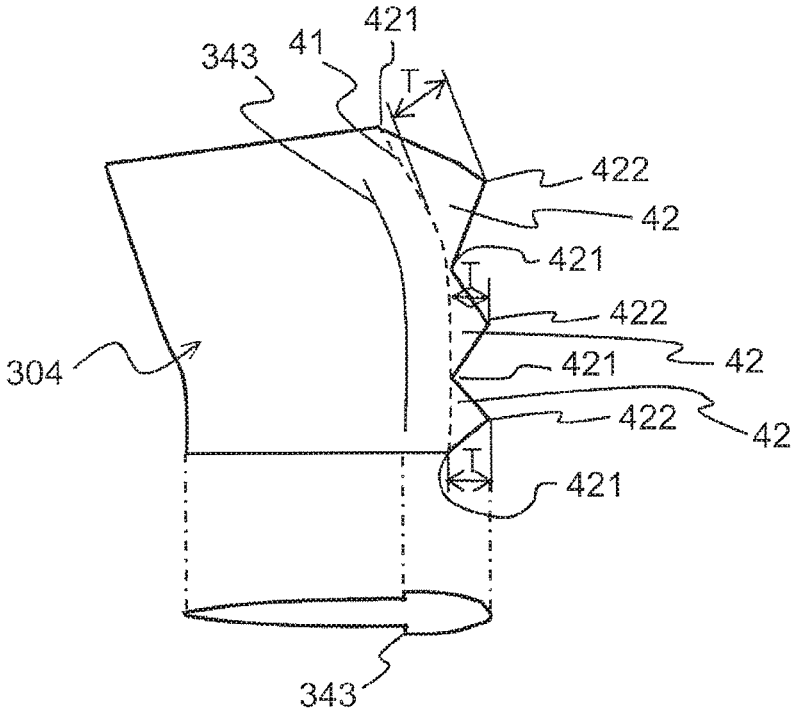
FIG. 8 is a view of a blade of a turbofan, which is in the same mode as FIG. 3, according to a fifth embodiment of the present invention.

Next, with reference to FIG. 8, a fifth embodiment of the present invention is described. FIG. 8 is a view of a blade of a turbofan, which is in the same mode as FIG. 3, according to the fifth embodiment of the present invention. The fifth embodiment is the same as the above-mentioned first to fourth embodiments except for matters to be described below.

As illustrated in FIG. 8, in the turbofan according to the fifth embodiment, on both surfaces on downstream of the undulating protrusion portion 41*a* of the front edge portion 41 of a blade 304, there is formed a stepped portion 343 extending in a substantially perpendicular direction with respect to the flow. The stepped portion 343 is formed so that a thickness of the blade on a front edge side with respect to the stepped portion 343 is larger than a thickness of the blade on a rear edge side with respect to the stepped portion 343.

In FIG. 8, there is exemplified the undulating protrusion portion 41*a* according to the first embodiment. As described above, the fifth embodiment can be carried out in combination with any one of the first embodiment to the fourth embodiment. Thus, the undulating protrusion portion may be any mode illustrated in FIG. 5 to FIG. 7.

With such a configuration, the following advantages can be obtained. Through formation of the stepped portion 343 extending in the substantially perpendicular direction with respect to the flow, there may cause an effect of suppressing development of a boundary layer on the surface of the blade and an adverse effect of generating new turbulence due to the stepped portion 343. Through formation of the stepped portion 343 on downstream of the undulating protrusion portion of the front edge portion of the blade, the vortex is divided by the undulating protrusion portion of the front edge portion of the blade to stabilize the flow, and the airflow passes the stepped portion 343. Thus, without generation of new turbulence due to the stepped portion 343, only development of the boundary layer on the surface of the blade can be effectively suppressed. Also with this, the fluctuation of the vortex being a noise source can be suppressed. Therefore, noise reduction and low power consumption can be achieved.

In FIG. 8, there is exemplified a case where one stepped portion 343 is formed. However, the fifth embodiment is not limited thereto, and there may be formed more than or equal to two stepped portions.

Sixth Embodiment

Figure 9:
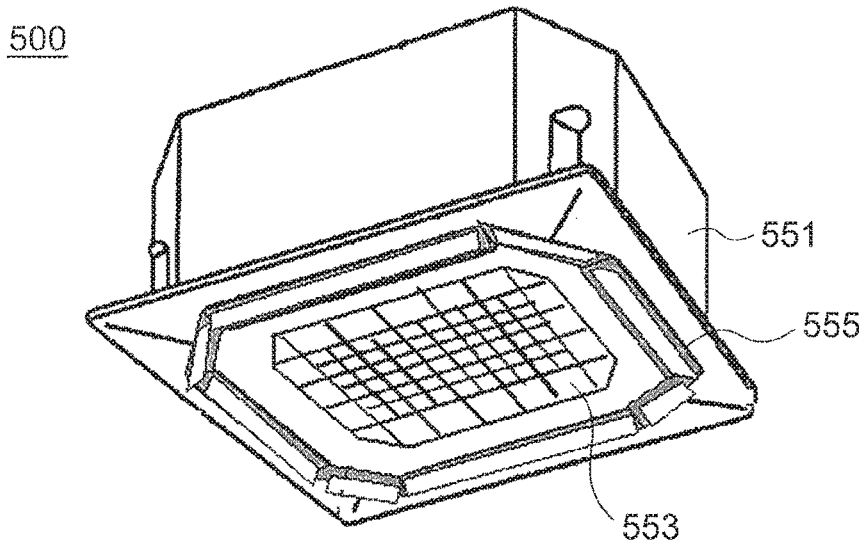
FIG. 9 is a schematic view of an indoor unit for an air conditioning apparatus according to a sixth embodiment of the present invention.

Next, with reference to FIG. 9, a sixth embodiment of the present invention is described. FIG. 9 is a schematic view of an indoor unit for an air conditioning apparatus according to the sixth embodiment of the present invention.

An indoor unit 500 for an air conditioning apparatus according to the sixth embodiment includes a case 551 embedded in a ceiling of a space to be air-conditioned. In a lower portion of the case 551, there are formed an inlet 553 of a grille type and a plurality of air outlets 555. In the case 551, the turbofan and a known heat exchanger (not shown) are accommodated. Further, the turbofan is any one of the turbofans according to the first embodiment to the fifth embodiment of the present invention described above.

According to the sixth embodiment, the indoor unit for an air conditioning apparatus with less noise can be provided.

Although the details of the present invention are specifically described above with reference to the preferred embodiments, it is apparent that persons skilled in the art may adopt various modifications based on the basic technical concepts and teachings of the present invention.

REFERENCE SIGNS LIST

1 boss, 2 main plate, 3 shroud, 4, 104, 204 blade, 31 intake hole, 41 front edge portion, 41*a*, 141*a*, 241*a* undulating protrusion portion, 42 protrusion, 100 turbofan, 343 stepped portion, 421 valley portion, 422 peak portion, 500 indoor unit for air conditioning apparatus

The invention claimed is:

1. A turbofan, comprising:

a boss rotatable about an axis;

a main plate connected to the boss;

a shroud having an intake hole; and a plurality of blades arranged between the main plate and the shroud, wherein each of the plurality of blades comprises, at a front edge portion thereof, an undulating protrusion portion including a plurality of protrusions, the protrusions are arranged at pitches that become smaller approaching the main plate side, the undulating protrusion portion is locally curved toward a front side in a rotation direction of the turbofan so that a positive pressure surface side of the undulating protrusion portion is concave.

2. A turbofan according to claim 1, wherein an amount of the curve of the undulating protrusion portion, which is locally curved toward the front side in the rotation direction of the turbofan, is larger on the shroud side.

3. A turbofan according to claim 1, wherein a thickness of a valley portion of the each of the plurality of protrusions of the undulating protrusion portion is smaller than a thickness of a peak portion of each of the protrusions of the undulating protrusion portion.

4. A turbofan according to claim 1, wherein each of the plurality of blades further comprises a stepped portion formed on downstream of the undulating protrusion portion of the front edge portion.

5. An indoor unit for an air conditioning apparatus, comprising the turbofan according to claim 1.

* * * * *